US005085328A

United States Patent [19]

Evenson

[11] Patent Number: 5,085,328

[45] Date of Patent: Feb. 4, 1992

[54] BROCHURE DISPLAY SYSTEM

[75] Inventor: Mel Evenson, San Pedro, Calif.

[73] Assignee: Eldon Industries, Inglewood, Calif.

[21] Appl. No.: 597,792

[22] Filed: Oct. 15, 1990

[51] Int. Cl.[5] ..... A47F 7/00

[52] U.S. Cl. ..... 211/55; 211/184; 211/194

[58] Field of Search ..... 211/55, 50, 56, 128, 211/184, 45, 194

[56] References Cited

U.S. PATENT DOCUMENTS

| | | | |
|---|---|---|---|
| 322,758 | 7/1885 | Snead | 211/50 |
| 1,211,065 | 1/1917 | Brady | 211/45 |
| 2,153,422 | 4/1939 | Kroman . | |
| 2,268,025 | 12/1941 | Erickson | 211/50 |
| 2,708,859 | 5/1955 | Adashek | 211/50 X |
| 2,869,732 | 1/1959 | Ganz . | |
| 2,872,144 | 2/1959 | Hobson . | |
| 3,298,538 | 1/1967 | Ganz et al. . | |
| 3,667,826 | 6/1972 | Wood et al. | 211/128 X |
| 3,807,572 | 4/1974 | Luvara et al. . | |
| 3,884,410 | 5/1975 | Giesecke . | |
| 3,905,484 | 9/1975 | Dean et al. . | |
| 4,062,452 | 12/1977 | Bartholomew | 211/55 |
| 4,083,456 | 4/1978 | Genn et al. . | |
| 4,183,438 | 1/1980 | Huczek | 211/128 X |
| 4,228,904 | 10/1980 | Dumond . | |
| 4,333,573 | 6/1982 | Holoubek . | |
| 4,476,985 | 10/1984 | Norberg et al. . | |
| 4,499,128 | 2/1985 | Strausheim . | |
| 4,535,704 | 8/1985 | Suttles | 211/128 X |
| 4,609,112 | 9/1986 | Belanger et al. | 211/45 |
| 4,768,659 | 9/1988 | Merl . | |
| 4,792,051 | 12/1988 | Miller . | |
| 4,796,764 | 1/1989 | Hardy | 211/55 X |
| 4,858,774 | 8/1989 | Winter et al. . | |
| 4,938,366 | 7/1990 | Carroll | 211/55 |

FOREIGN PATENT DOCUMENTS

| | | | |
|---|---|---|---|
| 2614427 | 10/1977 | Fed. Rep. of Germany | 211/55 |
| 0065654 | 2/1956 | France | 211/50 |
| 1184279 | 7/1959 | France | 211/50 |

*Primary Examiner*—Reinaldo P. Machado
*Assistant Examiner*—Sarah A. Lechok
*Attorney, Agent, or Firm*—Joseph C. Andras

[57] ABSTRACT

The present invention provides a multicomponent brochure display system comprised of a plurality of interconnectable brochure pockets and variable height brochure support shelves that interconnect with the brochure pockets. The preferred brochure pocket includes an open front enclosure having a bottom back wall and two side walls, the brochure pocket open front providing access to the back wall for mounting of the variable height brochure support shelves. One brochure pocket may serve as the front wall of a rearward brochure pocket when they are interconnected. A separate member is provided to serve as a front wall of the forwardmost brochure pocket. Also provided are an optional vertical divider and optical antisag tabs.

8 Claims, 6 Drawing Sheets

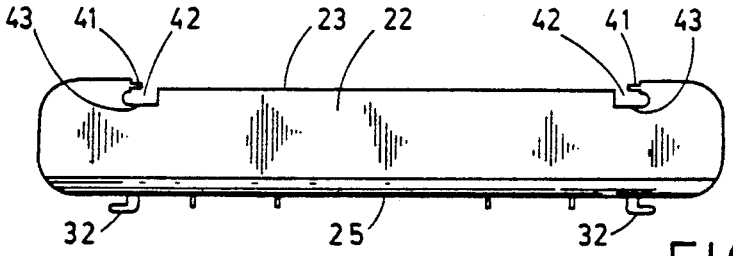
FIG.7
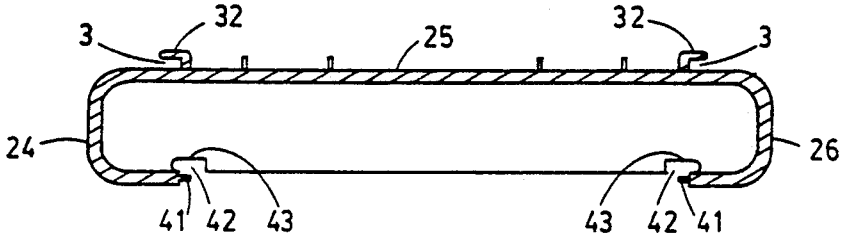
FIG.8
FIG.9
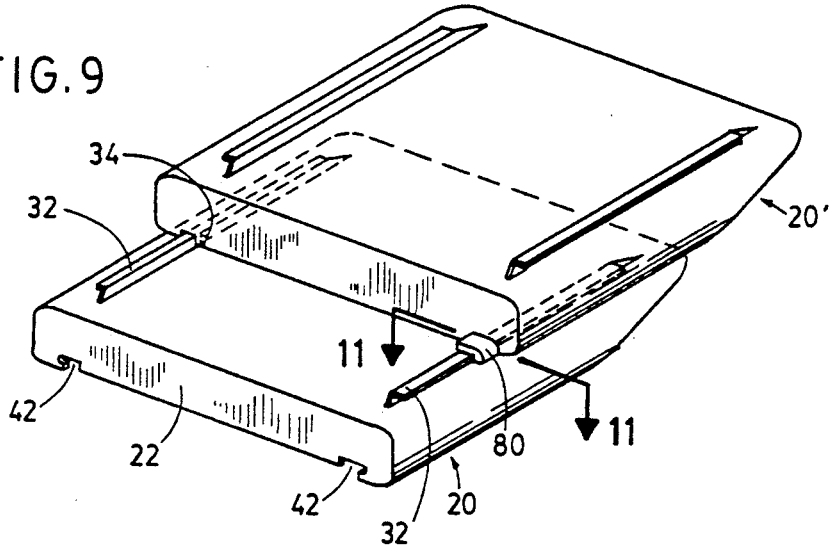
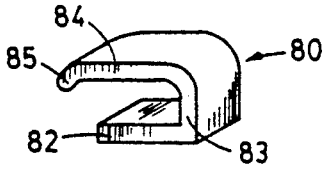
FIG.10
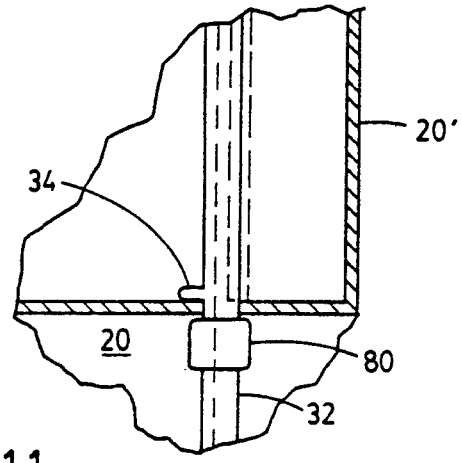
FIG.11

BROCHURE DISPLAY SYSTEM

BACKGROUND OF THE INVENTION

1. Field of the Invention

The present invention relates generally to an advertising display and, more particularly, to a versatile multipiece brochure display system having variable height brochure support shelves for allowing different sized brochures to be displayed with their top edges at substantially the same height.

2. Description of Background Art

The traditional display apparatus conventionally includes some type of support pocket in which brochures or other literature may be placed. An example of a single pocket apparatus is shown in U.S. Pat. No. 3,884,410 issued to Giesecke on May 20, 1975.

It is also conventional for a display apparatus to include a plurality of display levels, one behind the other, in a stair-step fashion. In this manner, the upper area of the literature placed on the steps of the display apparatus are visible. Exemplary multilevel display apparatus are set forth in U.S. Pat. No. 2,153,422 issued to Kroman on Apr. 4, 1939, and U.S. Pat. No. 4,228,904 issued to Dumond on Oct. 21, 1980.

The brochures and literature which the user desires to display are frequently of different heights and/or widths. The conventional display apparatus are not particularly suited to the display of varying sized brochures, because the top edges of the brochures are held at varying heights, making the overall display unattractive and somewhat impractical.

Another problem frequently encountered with brochure display apparatus is that a group of tall, somewhat flimsy brochures frequently fall forward over the front edge of the brochure pocket. One approach to this problem is shown in the Dumond patent mentioned above. The corners of the Dumond brochure pockets 46 are elevated, apparently to help maintain the upright position of the brochures held therein. However, the Dumond brochure pockets are of a fixed height and serve merely to block the view of a shorter brochure that does not require such support.

The conventional brochure display apparatus are also not particularly suited for displaying both full width and half width brochures. The conventional brochure display pockets are particularly of one unchangeable size and, therefore, narrow brochures placed in such brochure display pockets tend to intermix with one another.

Finally, the conventional brochure display apparatus does not allow the user to vary the number of brochure pockets making up a particular display system.

SUMMARY OF THE INVENTION

It is an object of the present invention to improve the above-noted shortcomings in the conventional display apparatus. In particular, it is an object of the present invention to provide a versatile multipocket brochure display that is both attractive and functional;

It is a further object of the present invention to provide a brochure display apparatus that is capable of carrying different height brochures at different levels so that the tops of the brochures are at substantially the same height relative to the top and/or bottom edges of the brochure display pockets;

It is a further object of the present invention to provide a brochure display apparatus that includes an optional member that may be installed on a front wall of the brochure pocket to help prevent the brochures from falling forward; and It is a further object of the present invention to provide a brochure display apparatus having a plurality of interconnectable brochure display pockets and means for prohibiting the brochure pockets from being inadvertently separated from one another.

In accordance with the above objects, a brochure display system according to the present invention is comprised of a brochure pocket having a bottom and an enclosure that includes a back wall and a front wall, a top of the brochure pocket being substantially open for insertion of a plurality of brochures therein; a brochure support shelf; and means for attaching the brochure support shelf to the back wall of the brochure pocket at variable heights relative to the bottom of the brochure pocket so that a displacement from a top of each brochure relative to the bottom of the brochure pocket may be varied.

BRIEF DESCRIPTION OF THE DRAWINGS

The just-summarized invention will now be described in detail in conjunction with the drawings, of which:

FIG. 7 is a bottom plan view of the brochure pocket of FIG. 4;

FIG. 8 is a sectional view of the brochure pocket of FIG. 4 taken along line 8—8;

FIG. 9 is a perspective view showing how one preferred brochure pocket is connected to another preferred brochure pocket and illustrating a preferred U-shaped pocket lock for maintaining such interconnection;

FIG. 10 is a perspective view of the U-shaped pocket lock referred to in the description of FIG. 9;

FIG. 11 is a cross-sectional view taken along line 11—11 of FIG. 9;

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to make a versatile multicomponent brochure display system having variable height brochure support shelves, optional vertical dividers, and optional antisag tabs.

Figure 1:
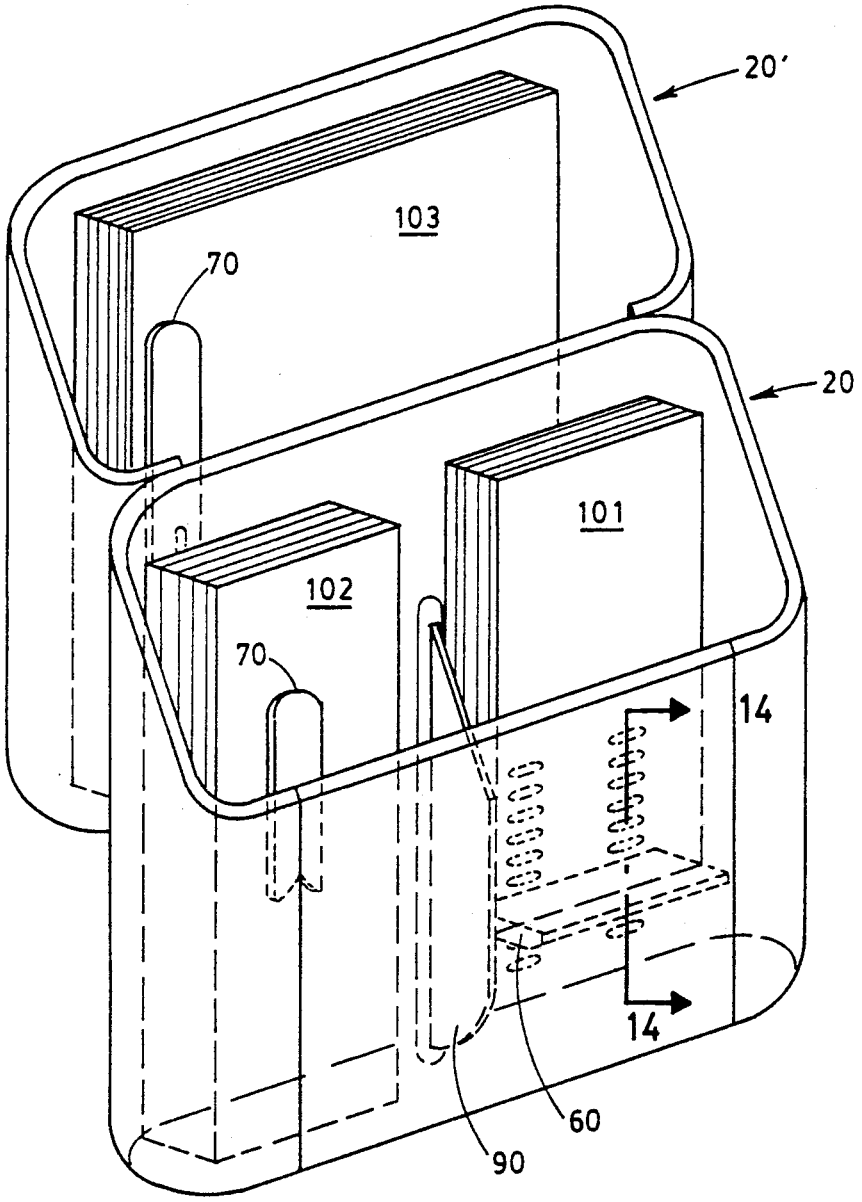
FIG. 1 is a perspective view of the various components making up a brochure display system according to the present invention used to display a plurality of brochures of different heights and widths.
Figure 2:
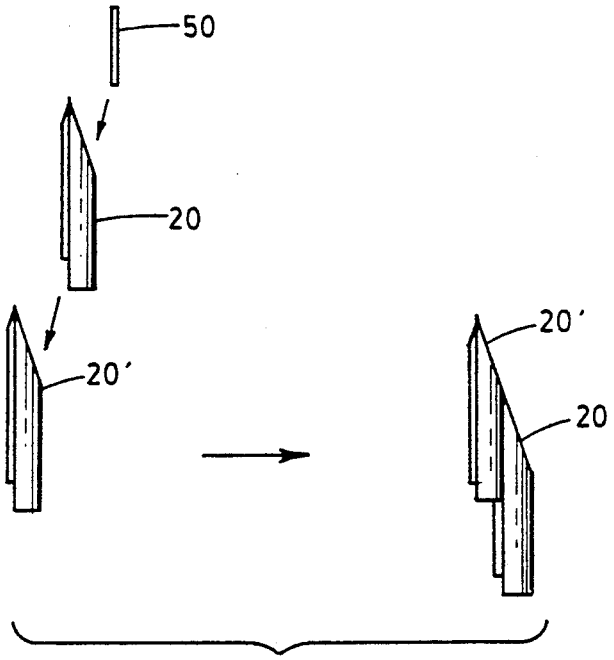
FIGS. 2 and 3 are exploded side and front views showing how two identical brochure pockets according to a preferred embodiment of the present invention, along with a front wall, interconnect with one another.
Figure 3:
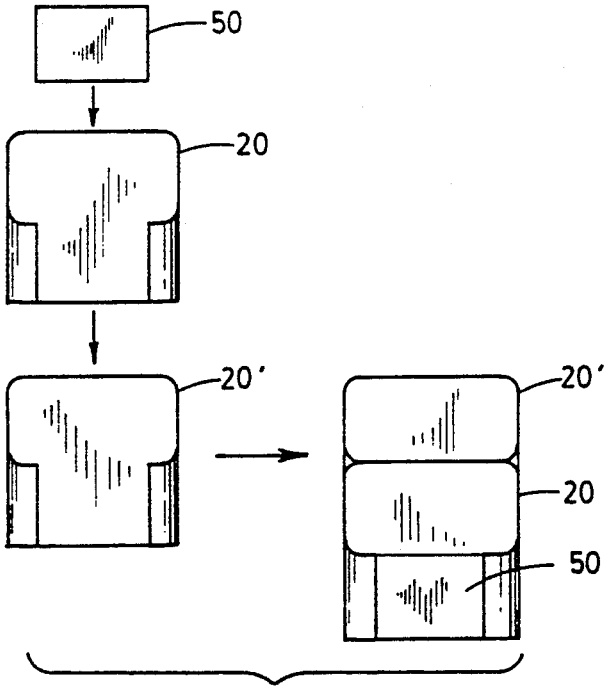
Figure 4:
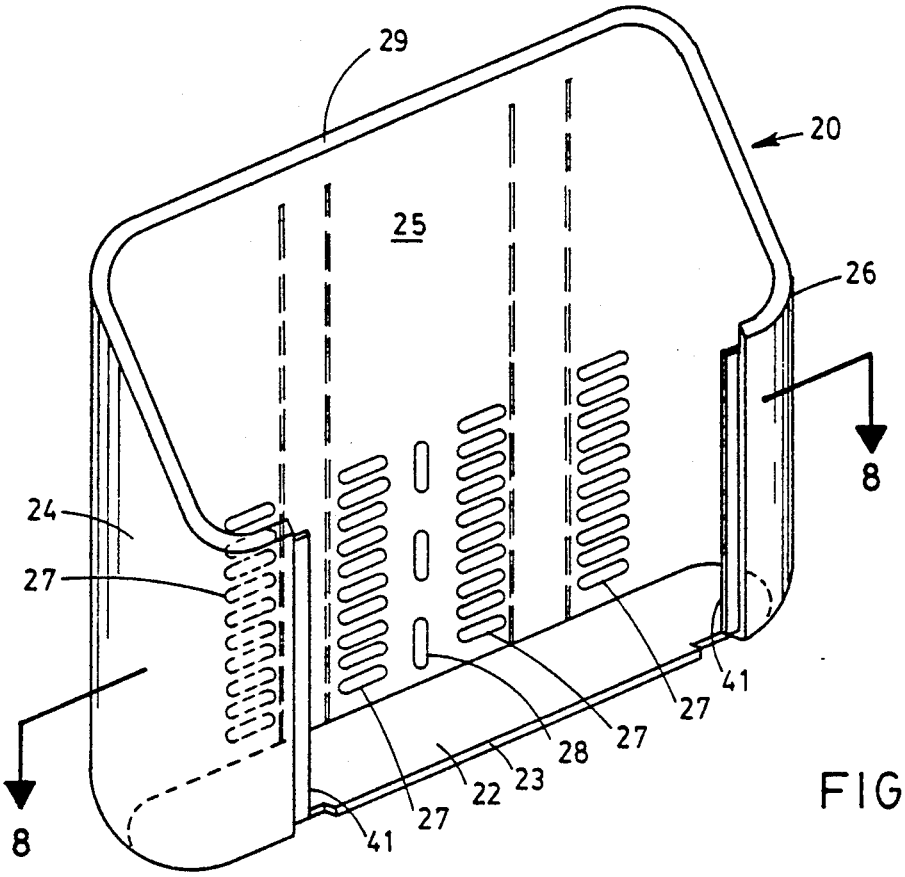
FIG. 4 is a perspective view of a single preferred brochure pocket according to the present invention.
Figure 5:
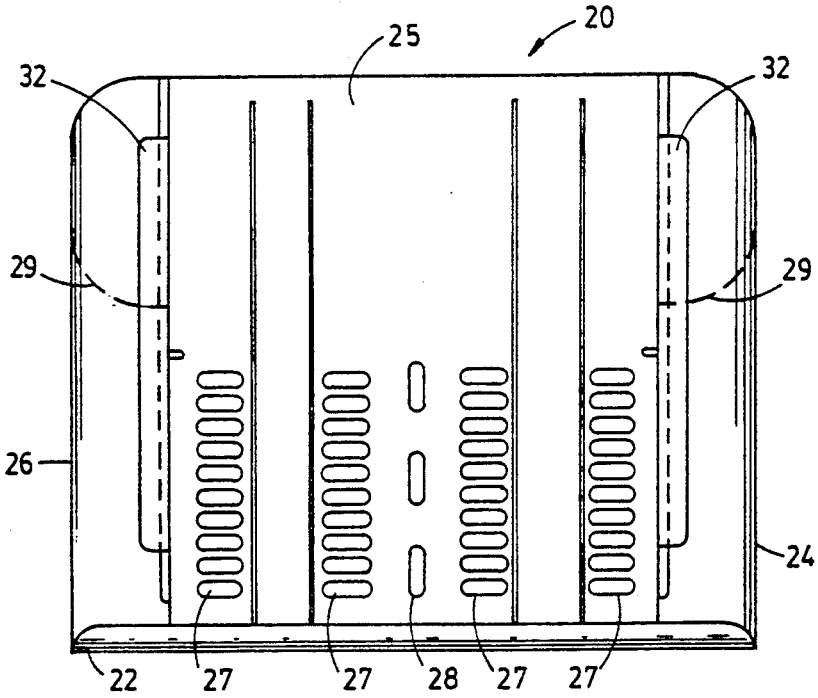
FIG. 5 is a rear elevational view of the brochure pocket of FIG. 4.
Figure 6:
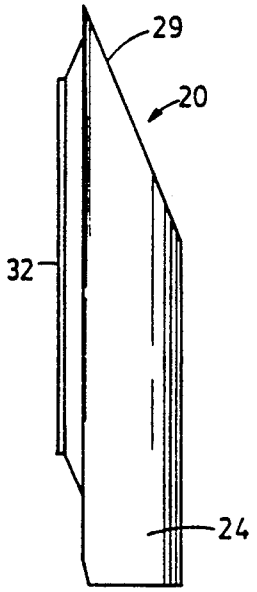
FIG. 6 is a side elevational view of the brochure pocket of FIG. 4.

A preferred embodiment of the present invention is depicted in FIG. 1. As shown, the preferred embodiment is generally comprised of a plurality of identical interconnectable brochure pockets 20, 20′ and an interconnectable front wall 50. FIGS. 2 and 3 depict an exemplary series of connecting steps between a pair of identical brochure pockets 20, 20′ and a front wall 50 that leads to the arrangement shown in FIG. 1.

Referring back to FIG. 1, it can be seen that the purpose of the present invention is to display a plurality of brochures 101, 102, 103. Moreover, it is the purpose of the present invention to display the brochures 101, 102, 103 at substantially the same height relative to a bottom of the brochure pockets 20, 20′ even though the brochures may be of different heights. The key to such equal height display is the provision of a brochure support shelf 60 that can be interconnected to the brochure pockets 20, 20′ at varying points thereon.

Also depicted in FIG. 1 are optional antisag tabs 70 and an optional vertical divider 90. The antisag tabs 70 may be installed, when needed, to assist in preventing the brochures 102, 103 from falling forward under their own weight. As shown, the width of the antisag tab is relatively narrow in comparison to the width of the overall brochure pocket 20. Thus, the antisag tab blocks only a very limited portion of the brochure in preventing it from falling forward. The vertical divider 90 may be used when brochures 101, 102, that are approximately one-half of the width of the brochure pockets 20, 20′, are to be displayed. The vertical divider 90 prevents the half-width brochures 101, 102 from intermixing.

The construction of a preferred brochure pocket 20 will now be described with reference to FIGS. 4 to 8. The preferred method of manufacturing is molded plastic. However, it should be understood that the components of the present invention may be manufactured from any material and with any known manufacturing process. A brochure pocket 20 is comprised of a bottom 22 and an enclosure made up of a back wall 25, a left side wall 24, and a right side wall 26. In the preferred embodiment, the brochure pocket 20 includes a beveled edge 29 that slants downward from the back wall 25 along the left and right side walls 24, 26. The beveled edge 29 provides an attractive yet functional shape for supporting and dispensing brochures. It can further be seen that the back wall 25 carries a plurality of notch sets 27, 28, 27, the purpose of which will be described further herein. The bottom 22 of the brochure pocket 20 includes a front edge 23, and the left and right side walls 24, 26 each carry a longitudinal tongue 41.

As probably best shown in FIG. 7, the front edge 23 terminates in expanded ends 43 that define a pair of L-shaped apertures 42. As also shown in FIG. 7, each preferred brochure pocket includes a pair of L-shaped rails 32 extending from the back wall 25.

The L-shaped rails 32 on the back of a first brochure pocket 20 serve to connect that brochure pocket 20 to the L-shaped apertures 42′ of a second brochure pocket 20′.

This interconnection is best shown in FIG. 9, where a brochure pocket 20 has been interconnected to another brochure pocket 20′. A protrusion or stop member 34 is present on the back wall 25 of the brochure pocket 20 in order to prohibit the brochure pocket 20 from sliding further relative to the brochure pocket 20′ than that shown in FIGS. 2 or 9.

FIG. 10 depicts a preferred U-shaped pocket lock 80 according to the present invention. The pocket lock 80, comprised of a base 82, a side 83, a top 84, and a locking lip 85, is preferably made from a partially elastic material. As shown in FIG. 9, the U-shaped pocket lock 80 is pressed onto the L-shaped rail 32 of the brochure pocket 20 to prevent upward movement of the brochure pocket 20 relative to the brochure pocket 20′.

Figure 17:
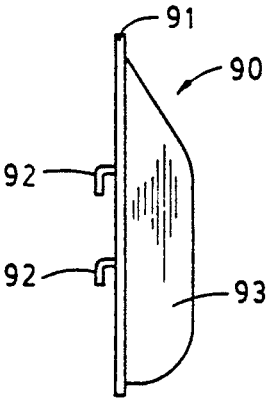
FIG. 17 is a side elevational view of a preferred vertical divider which may be optionally used to divide a brochure pocket into two vertical halves as shown in FIG. 1.

FIG. 17 depicts the preferred construction of the vertical divider 90. As shown, the vertical divider 90 is comprised of a substantially flat support flange 91, a substantially flat divider vane 93 extending perpendicularly from a front side of the support flange 91, and a pair of hooks 92 extending from a back side of the support flange 91. The vertical divider may be demountably attached to the brochure pocket 20 by simply inserting into hooks 92 into a pair of corresponding slots 28 carried by the back wall 25. As shown in FIG. 1, the support flange 91 is flush against the back wall 25 when the vertical divider 90 is mounted and thereby helps to inhibit side to side movement of the vertical divider 90.

The cross-sectional view of FIG. 11 depicts the inhibiting interaction between the stop member 34 and the pocket lock 80. As can be seen, the stop member 34 prevents downward movement of the brochure pocket 20 relative to brochure pocket 20′, and the pocket lock 80 prevents upward movement therebetween. Hence, the stop member 34 and the U-shaped pocket lock 80 serve to maintain the interconnection between the brochure pockets and thereby prevent a person from inadvertently knocking the two brochure pockets away from one another.

Figure 12:
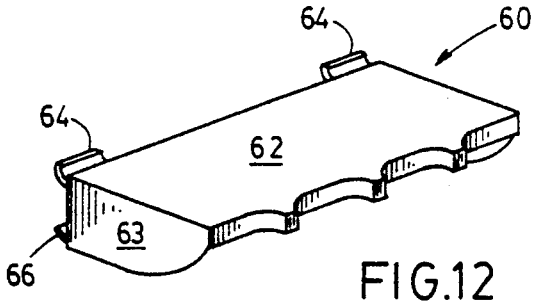
FIG. 12 is a perspective view of a preferred brochure support shelf according to the present invention.
Figure 13:
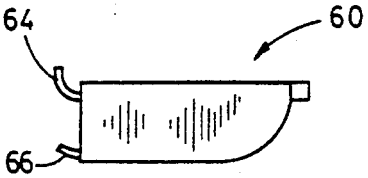
FIG. 13 is a side elevational view of the brochure support shelf of FIG. 12.

FIGS. 12 and 13 depict a preferred brochure support shelf that may be interconnected to the back wall 25 of the brochure pocket 20 at variable heights relative to the bottom 22. The preferred brochure support shelf 60 is comprised of a back wall 65, a pair of side walls 63, 63, and an upper surface 62. A pair of curved upper retaining tabs 64 and a pair of lesser curved lower retaining tabs 66 extend from the back wall 65 of the brochure support shelf 60.

Figure 14:
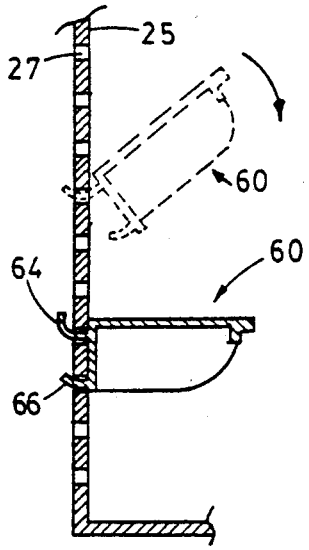
FIG. 14 is a cross-sectional view taken along lines 14—14 of FIG. 1 showing the method of variable height interconnection between the brochure support shelf of FIG. 12 and the rear wall of the brochure pocket of FIG. 1.

The preferred method of interconnection between the brochure support shelf 60 and the back wall 25 is depicted in the cross-sectional view of FIG. 14. As shown, the upper and lower retaining tabs 66, 64 interconnect with the previously-described notches 27. The brochure support shelf is installed by inserting the upper retaining tabs 64 and a corresponding pair of notches 27 in a first position and then lowering the brochure support shelf 60 to a second position where the lower retaining tabs 66 interconnect with a lower pair of notches 27 to help horizontally support the brochure support shelf 60.

Figure 15:
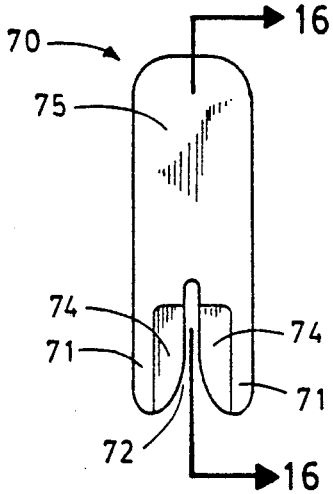
FIG. 15 is a front elevational view of a preferred antisag tab that may be optionally installed on either the back of a brochure pocket as shown in FIG. 1, or the back of a preferred front wall as shown in FIG. 18.
Figure 16:
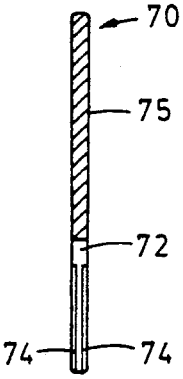
FIG. 16 is a cross-sectional view taken along line 16—16 of FIG. 15.

FIG. 15 depicts a front elevational view of the antisag tab 70 referred to briefly in the description of FIG. 1. As shown, the antisag tab 70 is comprised of an upper body portion 75 from which a pair of identical fingers 71 extend, the fingers 71 defining a slot 72 therebetween. A pair of shallow, substantially rectangular depressions 74 are present on each side of each finger 71 adjacent to the slot 72.

Figure 18:
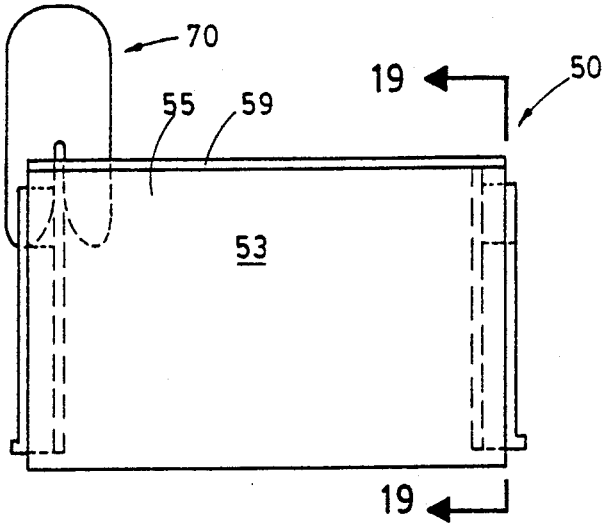
FIG. 18 is a front elevational view of a preferred front wall showing an antisag tag optionally installed thereon.
Figure 19:
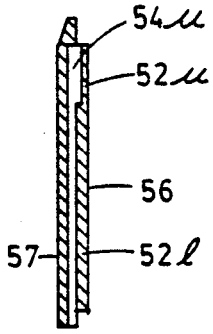
FIG. 19 is a cross-sectional view of the preferred front wall of FIG. 18 taken along line 19—19.
Figure 20:
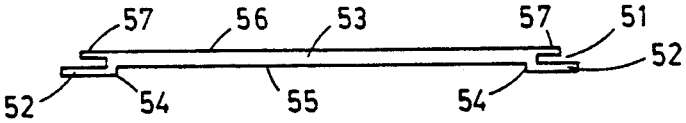
FIG. 20 is a bottom plan view of the preferred front wall of FIG. 18.

A front elevational view of a preferred front wall 50 is depicted in FIG. 18. The front wall 50 is comprised of a central plan portion 53 having a front surface 55 and a rear surface 56. As shown by the hidden lines of FIG. 18 and in the bottom elevational view of FIG. 20, a pair of L-shaped rails 52 extend from either side of the central planar portion 53. As shown in FIG. 19, the L-shaped rails 52 include a thicker lower portion 52L and a thinner upper portion 52U in order to define a space 54U. A pair of thin extension members 57 extend from the central planar portion 53 and parallel with the L-shaped rails 52. A beveled edge 59 is present to pleasingly mesh with the beveled edge 29 of the brochure pocket 20 when the front wall 50 is connected thereto as shown in FIG. 1.

The preferred front wall 50 is connected to the brochure pocket 20 by sliding the outwardly open grooves 51 down onto the inwardly-extending tongues 41 of the brochure pocket 20. The upper space 54U is provided to accommodate the fingers 71 of the antisag tab 70, as shown in FIG. 18.

Figure 21:
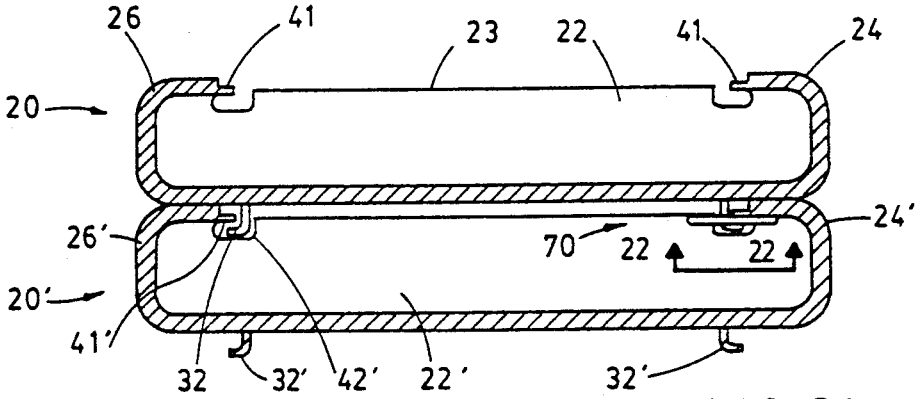
FIG. 21 is a top plan view of two interconnected brochure pockets with an antisag tab installed thereon.
Figure 22:
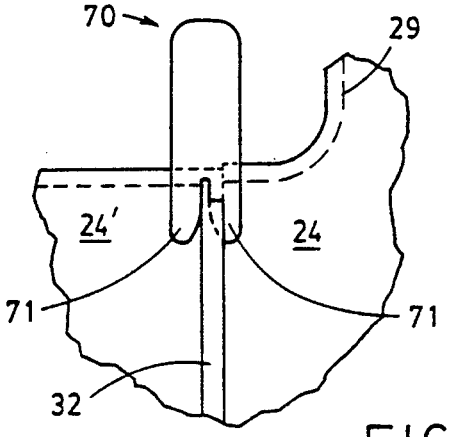
FIG. 22 is a detailed inside elevational view of the antisag tab installation of FIG. 21, this view being taken along line 22—22.

FIG. 21 is a top plan view of a first brochure pocket 20 interconnected with a second brochure pocket 20'. As shown, the L-shaped rails 32 of the first brochure pocket 20 pass through the L-shaped aperture 42' and rest against the back wall 25' of the other brochure pocket 20'. The interconnect relationship between the antisag tab 70 and the interconnected brochure pockets 20, 20' is also depicted in FIG. 21. As shown, the antisag tab 70 engages the L-shaped rail 32 where it connects to brochure pocket 20. This engaging relationship is most clearly shown in FIG. 22, which is an inside elevational view of FIG. 21. It can be seen in FIG. 22 that the fingers 71 of the antisag tab 70 slidingly engage either side of the L-shaped rail 32 where it engages the brochure pocket 20.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A brochure display system comprising:

a brochure pocket having a bottom and an enclosure that includes a back wall and a front wall, the back wall having a plurality of vertically arranged divider notches substantially at a center thereof;

a top of the brochure pocket being substantially open for insertion of a plurality of brochures therein;

a demountable vertical divider vertically separating the brochure pocket into two halves, the vertical divider comprised of a substantially flat support flange and a substantially flat divider vane extending perpendicularly from a forward side of the support flange, and a plurality of downward extending substantially L-shaped hooks extending perpendicularly from a rearward side of the support flange, the hooks demountably engaging the divider notches carried by the back wall;

a brochure support shelf having a width that is approximately one-half of the width of the brochure pocket;

means for attaching the brochure support shelf to the back wall of the brochure pocket at variable heights relative to the bottom of the brochure pocket and on either side of a vertical center of the brochure pocket so that different height brochures may be supported on either side of the vertical center in the same brochure pocket with a top of each brochure at substantially the same height.

2. The brochure display system of claim 1 wherein the brochure support shelf is comprised of:

a back wall;

a pair of side walls; and an upper surface carried by a back wall and a pair of side walls.

3. The brochure display system of claim 2 wherein the attaching means is comprised of:

a first and second plurality of vertically arranged shelf notches carried by the back wall of the enclosure to form a plurality of horizontally opposed shelf notches; and first and second upper retaining tabs extending away from and curving upwards relative to the back wall of the brochure support shelf, the upper retaining tabs capable of being inserted through a desired one of the plurality of horizontally opposed shelf notches when the brochure support shelf is in a first position relative to the back wall of the brochure pocket and capable of retaining the brochure support shelf against the back wall of the brochure pocket when the brochure support shelf is in a second position relative to the back wall of the brochure pocket.

4. The brochure display system of claim 3 wherein the brochure support shelf is further comprised of first and second lower retaining tabs, the lower retaining tabs capable of being inserted through a lower pair of horizontally opposed shelf notches to provide lateral stability to the brochure support shelf when in the second position.

5. The brochure display system of claim 1 wherein the front wall is removably attached to the brochure pocket.

6. The brochure display system of claim 1 further comprising an antisag tab demountably attached to the front wall of the brochure pocket, the antisag tab being substantially narrow in width relative to the width of the brochure packet and extending upward above the top of the brochure pocket so as to prevent brochures inserted therein from falling forward without preventing brochures stored therein from being viewed.

7. A brochure display system comprising:

first and second brochure pockets, each brochure pocket having a bottom, a back wall, a left wall, and a right wall, a top and front of the brochure pocket being substantially open;

first means for connecting the back wall of the first brochure pocket to the open front of the second brochure pocket, the first connecting means comprising a pair of longitudinal outwardly-facing L-shaped rails carried by the back wall of the first brochure pocket and defining a pair of longitudinal grooves and a pair of longitudinal inwardly-facing tongues, each tongue carried by the left and right walls of second brochure pocket, the pair of longitudinal tongues of the second brochure pocket slidably engaging the pair of longitudinal grooves of the first brochure pocket;

first means for preventing the respective brochure pockets from sliding relative to one another beyond a certain predetermined distance in a first direction as the tongues of the second brochure pocket slidably engage the grooves of the first brochure pocket;

second means for preventing the respective brochure pockets from sliding relative to one another in a second direction after the tongues of the second brochure pocket are slidably engaged with the grooves of the first brochure pocket;

a front panel;

second means for commenting the front panel to the open front of the first brochure pocket;

a brochure support shelf; and means for attaching the brochure support shelf to the back wall of the first or second brochure pocket at variable heights relative to the bottom of the brochure pocket so that different height brochures may be supported thereon with a top of each brochure at substantially the same height relative to the bottom of the brochure pocket.

8. The brochure display system of claim 7 wherein a portion of the L-shaped rail of the first brochure pocket extends beyond the bottom of the second brochure pocket when the first and second brochure pockets are connected to one another and wherein the second means is comprised of a U-shaped member, the U-shaped member being sized to transversely and demountably engage the extending portion of at least one of the L-shaped rails of the first brochure pocket adjacent to a corresponding groove at the bottom of the second brochure pocket.

* * * * *